US006821288B2

(12) United States Patent
Schaeffer

(10) Patent No.: US 6,821,288 B2
(45) Date of Patent: Nov. 23, 2004

(54) AUTOMATED THERAPY TABLE AND METHOD THEREFOR

(76) Inventor: Dwight Schaeffer, 7329 E. Stetson Dr. #20, Scottsdale, AZ (US) 85251

( * ) Notice: Subject to any disclaimer, the term of this patent is extended or adjusted under 35 U.S.C. 154(b) by 26 days.

(21) Appl. No.: 10/105,399

(22) Filed: Mar. 26, 2002

(65) Prior Publication Data

US 2003/0040686 A1 Feb. 27, 2003

Related U.S. Application Data

(60) Provisional application No. 60/313,726, filed on Aug. 21, 2001.

(51) Int. Cl.[7] ..... A61G 13/08; A61H 1/02

(52) U.S. Cl. ..... 606/240; 606/243; 128/845; 601/5; 601/24; 601/33

(58) Field of Search ..... 128/845; 606/237, 606/240, 243; 601/5, 23, 24, 26, 33, 34, 35, 49, 86, 87, 90, 93, 98, 101; 602/33, 32, 36

(56) References Cited

U.S. PATENT DOCUMENTS

| | | | | | |
|---|---|---|---|---|---|
| 137,596 | A | | 4/1873 | Clinton | |
| 1,046,736 | A | | 12/1912 | Clayton | |
| 1,082,043 | A | | 12/1913 | Payne | |
| 1,194,939 | A | | 8/1916 | Bishop | |
| 1,626,091 | A | | 4/1927 | Macklin | |
| 4,059,255 | A | | 11/1977 | Perold | |
| 4,271,830 | A | | 6/1981 | Moon | |
| 4,387,888 | A | | 6/1983 | Marinakis | |
| 5,014,688 | A | | 5/1991 | Fast | |
| 5,099,828 | A | * | 3/1992 | Duke | 601/26 |
| 5,207,216 | A | * | 5/1993 | Sweeny | 601/5 |
| 5,335,649 | A | * | 8/1994 | Randall et al. | 601/24 |
| 5,443,439 | A | * | 8/1995 | Ohshita | 601/90 |
| 5,794,286 | A | | 8/1998 | Scott et al. | |
| 5,840,001 | A | | 11/1998 | Schedel | |
| 6,019,740 | A | | 2/2000 | Hausman | |

* cited by examiner

*Primary Examiner*—Danton DeMille
(74) *Attorney, Agent, or Firm*—Jeffrey Weiss; Harry M. Weiss; Weiss, Moy & Harris, P.C.

(57) ABSTRACT

An automated therapy table having various support portions capable of being independently and automatically actuated by a physical therapist or other medical practitioner in order to move parts of a person's body medially/laterally, posteriorly/anteriorly and rotatably without causing physical stress to the medical practitioner.

3 Claims, 1 Drawing Sheet

AUTOMATED THERAPY TABLE AND METHOD THEREFOR

RELATED APPLICATION

This application claims priority to a corresponding provisional application U.S. Ser. No. 60/313,726, filed Aug. 21, 2001 in the name of the applicant of this application.

FIELD OF THE INVENTION

This invention relates generally to therapy tables and, more specifically, to an automated therapy table and method therefor having various body part support portions capable of independent automatic actuation in order to allow a physical therapist to easily move parts of a person's body medially/laterally, posteriorly/anteriorly and rotatably in order to create myofascia release and to cause other physical improvements.

BACKGROUND OF THE INVENTION

Many people suffer from physical pain and discomfort in their muscles and joints. One common source of such pain has to do with the myofascia, a thin film that wraps around muscle tissue. The myofascia wraps around the muscle fibers individually as well as the muscles themselves and also forms the tendons and ligaments which connect the muscles to other parts of the body. It is the myofascia that supports the body's musculature. A great deal of pain can result when the myofascia of a person becomes tight or thick. Fibromyalgia syndrome (FMS) and myofascial pain syndrome (MPS) are two conditions in which the lack of myofascial flexibility is present. When the myofascia loses its elasticity, the efficiency of neurotransmitters, which communicate messages between the brain and the rest of body, are impaired. Among other symptoms, physical pain usually results from myofascial abnormalities.

People with various forms of muscle and/or joint pain often seek the assistance of a physical therapist, chiropractor or other medical practitioner in order to alleviate their discomfort. A physical therapist will often resort to stretching techniques to ease a patient's discomfort—positioning the patient on a therapy table and manually stretching the patient's body so as to increase the flexibility of the myofascia. As a therapist holds in place a portion of a patient's body, the myofacia are stretched and loosened, creating myofascia release in a person's body. This can be physically demanding for the therapist.

A need therefore existed for an automated therapy table which could be controlled by a physical therapist or other medical practitioner to actuate various component portions of the table in order to move parts of a person's body in a desired direction for a desired period of time without causing physical stress to the medical practitioner.

SUMMARY OF THE INVENTION

An object of the present invention is to provide an automated therapy table capable of being controlled by a medical practitioner to actuate various component portions of the table in order to manipulate parts of a person's body in desired directions to desired locations and for desired periods of time for purposes of myofascia release without causing undue physical stress to the medical practitioner.

BRIEF DESCRIPTION OF THE PREFERRED EMBODIMENTS

In accordance with one embodiment of the present invention, an automated therapy table dimensioned to support a person in a horizontal position is disclosed, comprising, in combination, a lumbar portion having an inferior end and a superior end, a thoracic portion having an inferior end and a superior end, the inferior end of the thoracic portion is moveably coupled to the superior end of the lumbar portion, a first arm portion moveably coupled to a first side of the thoracic portion proximate the superior end of the thoracic portion, the first arm portion is capable of medial movement and lateral movement and posterior movement and anterior movement relative to the thoracic portion, a second arm portion moveably coupled to a second side of the thoracic portion proximate the superior end of the thoracic portion, the second arm portion is capable of medial movement and lateral movement and posterior movement and anterior movement relative to the thoracic portion, a head support having one end moveably coupled to the superior end of the thoracic portion and dimensioned to support the head of a person, and a drive mechanism dimensioned to permit independent automated movement of at least one of the lumbar portion and the thoracic portion and the first arm portion and the second arm portion and the head support.

In accordance with another embodiment of the present invention, a method for creating myofascia release in a person's body is disclosed, comprising, in combination, the steps of providing a lumbar portion having an inferior end and a superior end, providing a thoracic portion having an inferior end and a superior end, the inferior end of the thoracic portion is moveably coupled to the superior end of the lumbar portion, providing a first arm portion moveably coupled to a first side of the thoracic portion proximate the superior end of the thoracic portion, the first arm portion is capable of medial movement and lateral movement and posterior movement and anterior movement relative to the thoracic portion, providing a second arm portion moveably coupled to a second side of the thoracic portion proximate the superior end of the thoracic portion, the second arm portion is capable of medial movement and lateral movement and posterior movement and anterior movement relative to the thoracic portion, providing a head support having one end moveably coupled to the superior end of the thoracic portion and dimensioned to support the head of a person, providing a drive mechanism dimensioned to permit independent automated movement of at least one of the lumbar portion and the thoracic portion and the first arm portion and the second arm portion and the head support, selecting for movement at least one of the lumbar portion and the thoracic portion and the first arm portion and the second arm portion and the head support, selecting a direction of movement, and activating the drive mechanism.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
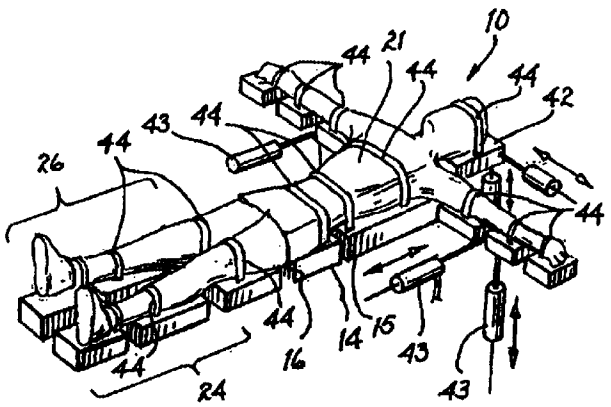
FIG. 1 is a perspective view of the preferred embodiment of the automated therapy table of the present invention.

Referring to FIGS. 1–4, the automated therapy table, hereinafter automated therapy table 10, of the present invention, is shown. The automated therapy table 10 is dimensioned to support a person in a supine or, if preferred by the therapist, a prone position. The table 10 preferably comprises a lumbar portion 14 having an inferior end 16 and a superior end 17 (shown in FIGS. 2–3). The table 10 further preferably comprises a thoracic portion 15 having an inferior end 19 and a superior end 18 (shown in FIGS. 2–3). The inferior end 19 of the thoracic portion 15 is preferably moveably coupled to the superior end 17 of the lumbar portion 14.

Figure 2:
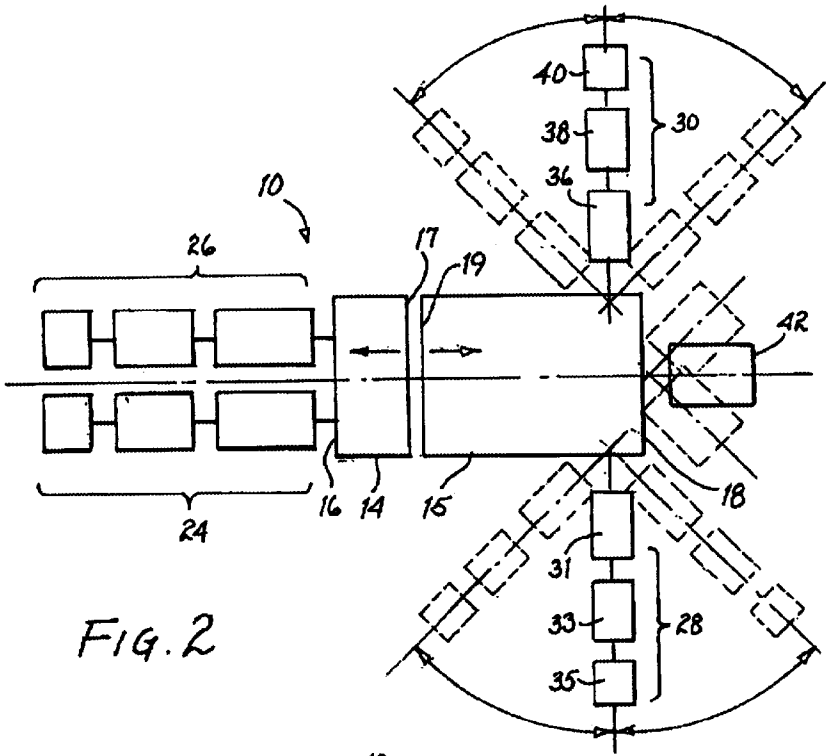
FIG. 2 is a top view of the automated therapy table of FIG. 1, showing medial/lateral movement of the various arm portions and supports, extension of the vertebral column, as well as medial/lateral movement of the head support.

As shown in FIG. 2, the superior end 17 of the lumbar portion 14 and the inferior end 19 of the thoracic portion 15 are preferably capable of anterior motion, so as to arch the back of a person 21 positioned on the table 10.

Referring now to FIG. 2, the automated therapy table 10 further preferably comprises a first arm portion 28 moveably coupled to a first side of the thoracic portion 15 proximate the superior end 18. While the first arm portion 28 could comprise a single section capable of medial/lateral or posterior/anterior movement, it is preferred that the first arm portion 28 be multi-sectioned in a manner corresponding to the arm and hand joints, with:

(a) a first upper arm support 31 having an inferior end 31*a* and a superior end 31*b* and dimensioned to support a person's arm between the shoulder joint and the elbow joint. The superior end 31*b* of the first upper arm support 31 is preferably moveably coupled to a first side of the thoracic portion 15 proximate the superior end 18;

(b) a first lower arm support 33 having an inferior end 33*a* and a superior end 33*b* and dimensioned to support a person's arm between the elbow joint and the wrist joint. The superior end 33*b* of the first lower arm support 33 is preferably moveably coupled to the inferior end 31*a* of the first upper arm support 31; and (c) a first hand support 35 having an inferior end 35*a* and a superior end 35*b* and dimensioned to support a person's hand. The superior end 35*b* of the first hand support 35 is preferably moveably coupled to the inferior end 33*a* of the first lower arm support 33.

The moveable coupling between the first upper arm support 31, the first lower arm support 33 and the first hand support 35 permits each of the aforesaid supports to be independently actuated, as dictated by the person actuating the therapy table 10.

Still referring to FIG. 2, the automated therapy table 10 further preferably comprises a second arm portion 30 coupled to a second side of the thoracic portion 15 proximate the superior end 18. Like the first arm portion 28, the second arm portion 30 may be a single section coupled to the thoracic portion 15 proximate the superior end 18 in a manner permitting medial/lateral or posterior/anterior movement of the second arm portion 30, but is preferably multi-sectioned. Its component portions preferably are as follows:

(a) a second upper arm support 36 having an inferior end 36*a* and a superior end 36*b* and dimensioned to support a person's arm between the shoulder joint and the elbow joint. The superior end 36*b* of the second upper arm support 36 is preferably moveably coupled to a second side of the thoracic portion 15 proximate the superior end 18;

(b) a second lower arm support 38 having an inferior end 38*a* and a superior end 38*b* and dimensioned to support a person's arm between the elbow joint and the wrist joint. The superior end 38*b* of the second lower arm support 38 is preferably moveably coupled to the inferior end 36*a* of the second upper arm support 36; and (c) a second hand support 40 having an inferior end 40*a* and a superior end 40*b* and dimensioned to support a person's hand. The superior end 40*b* of the second hand support 40 is preferably moveably coupled to the inferior end 38*a* of the second lower arm support 38.

The moveable coupling between the second upper arm support 36, the second lower arm support 38 and the second hand support 40 permits each of the aforesaid supports to be independently actuated.

Figure 4:
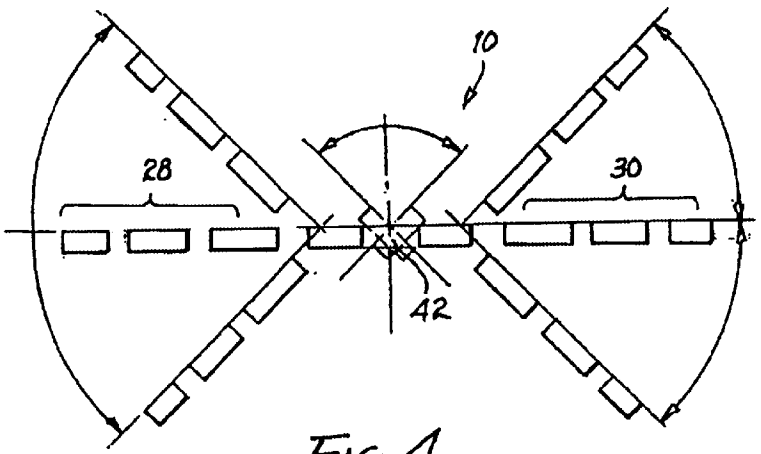
FIG. 4 is a side view of the automated therapy table of FIG. 1, showing anterior/posterior movement of the various arm portions and supports as well as rotation of the head support.

The first arm portion 28 (consisting of the first upper arm support 31, the first lower arm support 33, the first hand support 35), and the second arm portion 30 (consisting of the second upper arm support 36, the second lower arm support 38, and the second hand support 40) are each preferably dimensioned to be automatically adjusted in a range of motion along a medial/lateral axis (as shown in FIG. 2) and in a range of motion along a anterior/posterior axis (as shown in FIG. 4). The range of motion selected by the therapist or other person operating the table 10 will be dictated by the physical needs of the person positioned on the table 10.

Figure 3:
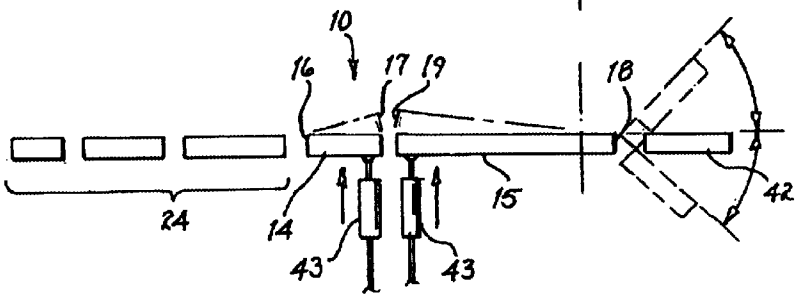
FIG. 3 is a side view of the automated therapy table of FIG. 1, showing anterior/posterior movement of the head support and arching of the lumbar region.

Referring now to FIGS. 1–4, the automated therapy table 10 further preferably comprises a head support 42 having one end moveably coupled to the superior end 18 of the thoracic portion 15 and dimensioned to support the head of a person 21. The head support 42 is preferably dimensioned to be automatically adjusted: (a) medially/laterally (as shown in FIG. 2); (b) anteriorly/posteriorly (as shown in FIG. 3); and (c) rotatably (as shown in FIG. 4), although it should be clearly understood that substantial benefit could be derived from an alternative embodiment of the automated therapy table 10 in which the head support 42 could only be adjusted medially/laterally or only anteriorly/posterially or only rotatably, or where the head support 42 is incapable of any movement.

Referring now to FIG. 1, the automated therapy table 10 further comprises a drive mechanism 43 dimensioned to permit independent automated actuation of at least one of the movements described above of: (a) the first arm portion 28 (including one or more of the first upper arm support 31, the first lower arm support 33, and the first hand support 35); (b) the second arm portion 30 (including one or more of the second upper arm support 36, the second lower arm support 38, and the second hand support 40); (c) the head support 42; and (d) the superior end 17 of the lumbar portion 14 and the inferior end 19 of the thoracic portion 15. This automated independent activation of the component portions of the automated therapy table 10 permits stretching of the connective tissue of a person in order to create myofascia release. In the preferred embodiment, the automated therapy table 10 is pneumatically driven. However, it should be clearly understood that substantial benefit could be derived from an alternative configuration of the automated therapy table 10 in which other automated means for adjusting the component portions and supports is used, such as hydraulic, electric or perhaps even lever-type means.

This apparatus and process makes the job of the therapist significantly less difficult and less physically demanding. Thus, instead of the therapist being required to bend over the table 10, grasp a portion of the patient's body, and physically move the patient's body in the desired direction for the required period of time—the therapist can select the desired body part (e.g., neck, right arm, left arm, etc.), the desired direction of movement (e.g., medial, lateral, posterior, anterior, etc.) and activate the drive mechanism 43. The drive mechanism 43 will then move the appropriate body part in the proper direction, and the body part will be held there until the therapist determines that sufficient time has passed to make it appropriate to release the body part. While it is generally contemplated that the therapist will activate the drive mechanism 43, it would be possible for the patient to do so as well.

It is preferred that the table 10 further comprise a first leg portion 24 (shown in FIGS. 1–3) and a second leg portion 26 (shown in FIGS. 1–2), each having a superior end coupled to the inferior end 16 of the lumbar portion 14 and each dimensioned to support the leg of a person 21 (shown in FIG. 1). However, it should be noted that the table 10 could be configured so that the first and second leg portions 24 and 26 comprise a single section, or still further so that the lumbar portion 14 and the first and second leg portions 24 and 26 all together comprise a single section.

It should be noted that it would be possible to couple the first leg portion 24 and the second leg portion 26 to the lumbar portion 14 in such a manner so as to permit anterior/posterior or medial/lateral movement of the leg portions 24 and 26 relative to the lumbar portion 14, and to provide an automated drive mechanism to power such movement.

Referring again to FIG. 1, the automated therapy table 10 further preferably comprises straps 44 dimensioned to secure a person 21 to the various portions of the automated therapy table 10: the first leg portion 24, the second leg portion 26, the lumbar portion 14, the thoracic portion 15, the first upper arm support 31, the first lower arm support 33, the first hand support 35, the second upper arm support 36, the second lower arm support 38, the second hand support 40, and the head support 42. The straps 44 stabilize the person 21 during use of the automated therapy table 10 by a therapist. Furthermore, the straps 44 aid the therapist in isolating select areas of the person 21 in order to allow for decompression, which relieves pressure on the joint capsule, and/or approximation, which relaxes ligaments. It should be noted that it in addition to straps 44, it would also be possible to use boots 45 (shown in FIG. 1) to secure the feet of a person 21 to the first leg portion 24 and the second leg portion 26.

While the invention has been particularly shown and described with reference to preferred embodiments thereof, it will be understood by those skilled in the art that the foregoing and other changes in form and details may be made therein without departing from the spirit and scope of the invention.

I claim:

1. An automated therapy table dimensioned to support a person in a horizontal position comprising, in combination:

a lumbar portion having an inferior end and a superior end;

a thoracic portion having an inferior end and a superior end, said inferior end of said thoracic portion is moveably coupled to said superior end of said lumber portion;

a first arm portion moveably coupled to a first side of said thoracic portion proximate said superior end of said thoracic portion, said first arm portion is capable of at least one of medial movement and lateral movement and posterior movement and anterior movement relative to said thoracic portion;

a second arm portion moveably coupled to a second side of said thoracic portion proximate said superior end of said thoracic portion, said second arm portion is capable of at least one of medial movement and lateral movement and posterior movement and anterior movement relative to said thoracic portion;

wherein each of said first and said second arm portions comprises a first upper arm support having an inferior end and a superior end and adapted to support an arm of a person between the shoulder joint and the elbow joint, said superior end of said first upper arm support is moveably coupled to said thoracic portion proximate said superior end of said thoracic portion;

a first lower arm support having an inferior end and a superior end and adapted to support an arm of a person between the elbow joint and the wrist joint, said superior end of said first lower arm support is moveably coupled to said inferior end of said first upper arm support; and a first hand support having an inferior end and a superior end and adapted to support a hand of a person, said superior end of said first hand support is moveably coupled to said inferior end of said first lower arm support; and a drive mechanism adapted to permit independent automated movement of at least one of said lumbar portion and said thoracic portion and at least one of said first arm portion and said second arm portion.

2. An automated therapy table dimensioned to support a person in a horizontal position comprising, in combination:

a lumbar portion having an inferior end and a superior end;

a thoracic portion having an inferior end and a superior end, said inferior end of said thoracic portion is moveably coupled to said superior end of said lumbar portion;

a first arm portion moveably coupled to a first side of said thoracic portion proximate said superior end of said thoracic portion, said first arm portion is capable of at least one of medial movement and lateral movement and posterior movement and anterior movement relative to said thoracic portion;

a second arm portion moveably coupled to a second side of said thoracic portion proximate said superior end of said thoracic portion, said second arm portion is capable of at least one of medial movement and lateral movement and posterior movement and anterior movement relative to said thoracic portion;

wherein each of said first and said second arm portions comprises a first upper arm support having an inferior end and a superior end and adapted to support an arm of a person between the shoulder joint and the elbow joint, said superior end of said first upper arm support is moveably coupled to said thoracic portion proximate said superior end of said thoracic portion;

a first lower arm support having an inferior end and a superior end and adapted to support an arm of a person between the elbow joint and the wrist joint, said superior end of said first lower arm support is moveably coupled to said inferior end of said first upper arm support; and a first hand support having an inferior end and a superior end and adapted to support a hand of a person, said superior end of said first hand support is moveably coupled to said inferior end of said first lower arm support;

wherein said first upper arm support and said first lower arm support and said first hand support are each dimensioned to be automatically adjusted in a range of motion along a medial/lateral axis and in a range of motion along an anterior/posterior axis; and a drive mechanism adapted to permit independent automated movement of at least one of said lumbar portion and said thoracic portion and at least one of said first arm portion and said second arm portion.

3. A method for creating myofascia release in a person's body comprising, in combination, the steps of:

providing a lumbar portion having an inferior end and a superior end;

providing a thoracic portion having an inferior end and a superior end, said inferior end of said thoracic portion is moveably coupled to said superior end of said lumbar portion;

providing a first arm portion moveably coupled to a first side of said thoracic portion proximate said superior end of said thoracic portion, said first arm portion is capable of at least one of medial movement and lateral movement and posterior movement and anterior movement relative to said thoracic portion;

providing a second arm portion moveably coupled to a second side of said thoracic portion proximate said superior end of said thoracic portion, said second arm portion is capable of at least one of medial movement and lateral movement and posterior movement and anterior movement relative to said thoracic portion;

providing a drive mechanism adapted to permit independent automated movement of at least one of said lumbar portion, said thoracic portion, said first arm portion, and said second arm portion;

selecting for movement at least one of said lumbar portion, said thoracic portion, said first arm portion, and said second arm portion;

selecting a direction of movement for at least one of said lumbar portion, thoracic portion; said first arm portion, and said second arm portion;

activating said drive mechanism and thereby causing movement of at least one of said lumbar portion, said thoracic portion, said first arm portion, and said second arm portion in said selected direction; and wherein said step of providing each of said first and said second arm portions further comprises the steps of:

providing a upper arm support having an inferior end and a superior end and adapted to support an arm of a person between the shoulder joint and the elbow joint, said superior end of said second upper arm support is moveably coupled to said thoracic portion proximate said superior end of said thoracic portion;

providing a lower arm support having an inferior end and a superior end and adapted to support an arm of a person between the elbow joint and the wrist joint, said superior end of said second lower arm support is moveably coupled to said inferior end of said second upper arm support;

providing a hand support having an inferior end and a superior end and adapted to support a hand of a person, said superior end of said second hand support is moveably coupled to said inferior end of said second lower arm support;

selecting for movement at least one of said upper arm support and said lower arm support and said hand support;

selecting a direction of movement for at least one of said upper arm support, said lower arm support and said hand support; and activating said drive mechanism and thereby causing movement of at least one of said first upper arm support, said lower arm support, and said hand support in said selected direction.

* * * * *